US010022886B2

(12) United States Patent
Saunders et al.

(10) Patent No.: US 10,022,886 B2
(45) Date of Patent: Jul. 17, 2018

(54) ROTARY CUTTING DIE FOR CUTTING CORRUGATED BOARD AND INCLUDING A PRODUCT EJECTOR WITH INTEGRAL GLUE TABS

(71) Applicant: Container Graphics Corporation, Cary, NC (US)

(72) Inventors: Neil Saunders, Raleigh, NC (US); James M. Smithwick, Jr., New Bern, NC (US)

(73) Assignee: Container Graphics Corporation, Cary, NC (US)

( * ) Notice: Subject to any disclaimer, the term of this patent is extended or adjusted under 35 U.S.C. 154(b) by 28 days.

(21) Appl. No.: 15/196,750

(22) Filed: Jun. 29, 2016

(65) Prior Publication Data

US 2018/0001503 A1 Jan. 4, 2018

(51) Int. Cl.
*B26F 1/38* (2006.01)
*B26D 7/01* (2006.01)

(52) U.S. Cl.
CPC ..... *B26F 1/384* (2013.01); *B26D 7/01* (2013.01)

(58) Field of Classification Search
CPC ..... B26D 7/01; B26F 1/384
USPC ..... 83/346, 347, 348, 109, 111, 112
See application file for complete search history.

(56) References Cited

U.S. PATENT DOCUMENTS 6,477,930 B1 * 11/2002 Sandford ..... B26D 7/1818 83/162
6,644,153 B1 * 11/2003 Gordon ..... B26D 7/1818 493/342
2012/0285306 A1 * 11/2012 Weibelt ..... B26D 7/1818 83/86
2014/0041493 A1 * 2/2014 Dulaney ..... B26F 1/384 83/13

* cited by examiner

*Primary Examiner* — Omar Flores Sanchez
(74) *Attorney, Agent, or Firm* — Coats & Bennett, PLLC

(57) ABSTRACT

A rotary cutting die apparatus is provided for die cutting corrugated board. The apparatus comprises a die board having one or more openings formed therein. A product ejector is secured in the one or more openings for engaging a portion of a die cut product and separating the die cut product from the cutting die. Each product ejector comprises compressible material and includes a main body and one or more tabs integral with the main body or operatively associated with the main body, wherein the tabs are secured to the openings or to another portion of the die board.

7 Claims, 8 Drawing Sheets

ROTARY CUTTING DIE FOR CUTTING CORRUGATED BOARD AND INCLUDING A PRODUCT EJECTOR WITH INTEGRAL GLUE TABS

FIELD OF THE INVENTION

The present invention relates to rotary cutting dies specifically designed to cut and score corrugated board that is used in making corrugated board boxes.

BACKGROUND OF THE INVENTION

Rotary cutting dies are used to cut and score sheets of corrugated board to produce a die cut product that can be manipulated into boxes. Rotary cutting dies typically include a curved die board that is configured to mount on a die cylinder. When used, the die cylinder and die board are mounted adjacent an anvil and a nip is defined between the cylinder and the anvil. Sheets of corrugated board are fed into and through the nip and, in the process, the sheet of corrugated board is cut and scored to form the die cut product. Die boards commonly include product and scrap cutting blades, scoring rules, trim and scrap strippers and product ejectors for separating the die cut product from the cutting die.

A common problem with rotary cutting dies that operate on corrugated board is that of controlling the pressure exerted against the corrugated board by the product ejectors. If the pressure is too great, the die cut product is damaged. That is, if the pressure is too great, the flutes are crushed. This makes the resulting boxes weaker and hence the boxes possess less stacking strength and the crushed flutes have a negative impact on the appearance of the product.

On the other hand, if the ejection force exerted by the product ejectors is too low, then this will impact the separation of the die cut product from the cutting die during the die cutting operation. That is, if the force is insufficient to dislodge or remove the cut die product from the cutting die, it follows that the product will continue with the cutting die and the die cutting operation will be seriously impacted.

One might consider seating the product ejector as deep into an opening in the die board as feasible in order to enhance control over the pressure exerted against the corrugated board by the product ejector. In the regard, one might consider gluing the entire sides of the product ejector to the wall of the opening in the die board. This, however, leads to even more problems. This can be referred to as a product ejector shear problem. When the entire product ejector (elastomer) is adhered to the die board, the repeated compressions and releasing creates shear forces and causes the product ejector to tear loose. Also, when the entire product ejector is adhered into the opening in the die board, it is possible for adhesive to wick into the main body and once in the main body the adhesive hardens and this can contribute to a cutting or tearing action that damages the product ejector.

SUMMARY OF THE INVENTION

The present invention addresses this problem, in one embodiment, by seating the product ejector as deep as feasible into an opening of the die board and providing the product ejector with one or more connected or integral tabs that project from the main body of the product ejector and which are adhered to the wall of the opening. This effectively isolates the main body of the product ejector from the adhesive and effectively separates the working portion of the product ejector from the structure utilized to secure the product ejector to the die board.

In one embodiment, the product ejector includes a main body and one or more tabs integral with the main body but spaced from the main body and adhered with adhesive to the wall of the opening in the die board. The main body can be compressed and released repeatedly without being significantly impacted by the adhesive or the manner in which the product ejector is secured within the opening of the die board. In one version of this embodiment, there is a channel defined between the tab and the main body. This effectively forms an open space that enables the main body of the product ejector to conform into when compressed and better isolates the main body tabs.

Other objects and advantages of the present invention will become apparent and obvious from a study of the following description and the accompanying drawings which are merely illustrative of such invention.

DESCRIPTION OF EXEMPLARY EMBODIMENTS OF THE INVENTION

Figure 1:
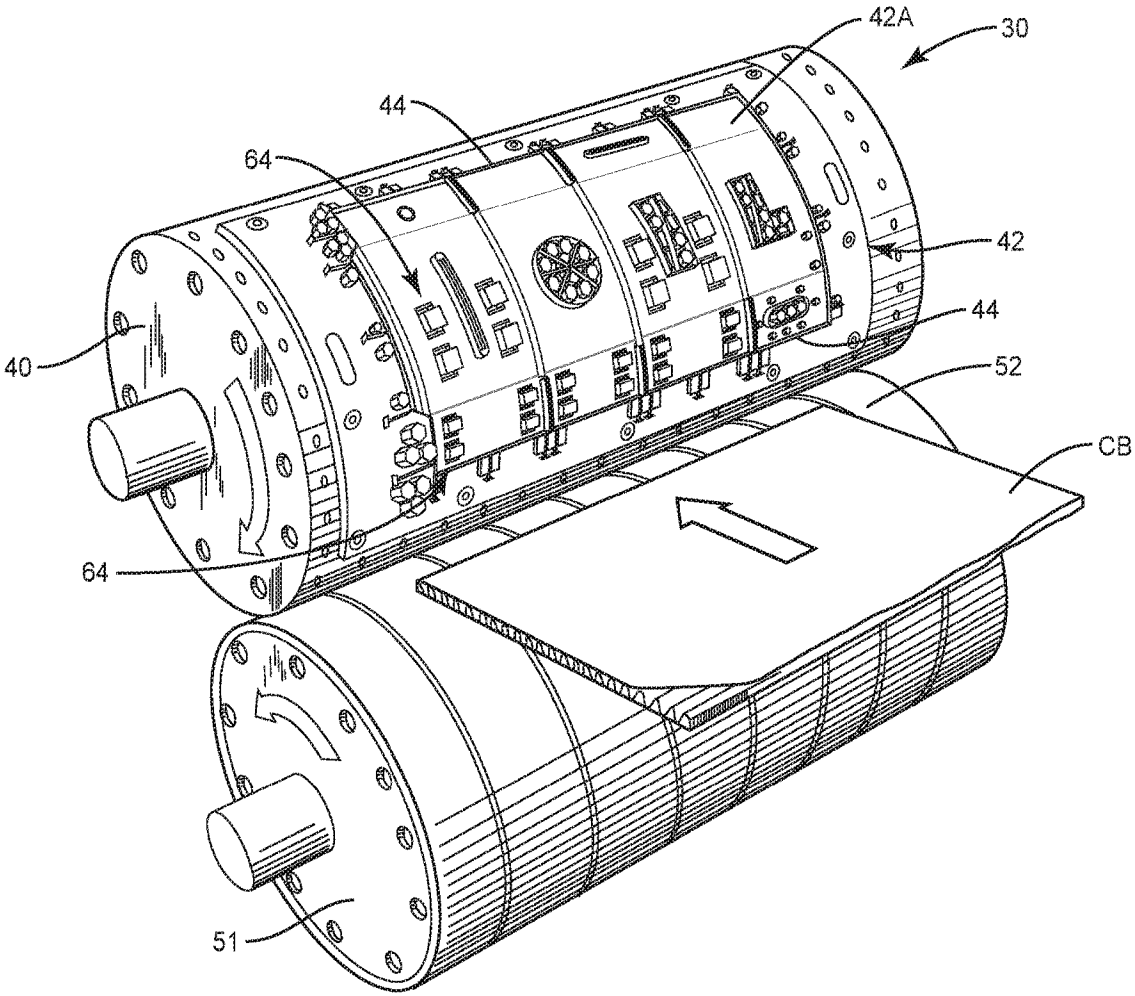
FIG. 1 is a perspective view of a rotary cutting die machine including a rotary cutting die mounted on a die cylinder and an anvil disposed adjacent the die cylinder.
Figure 2:
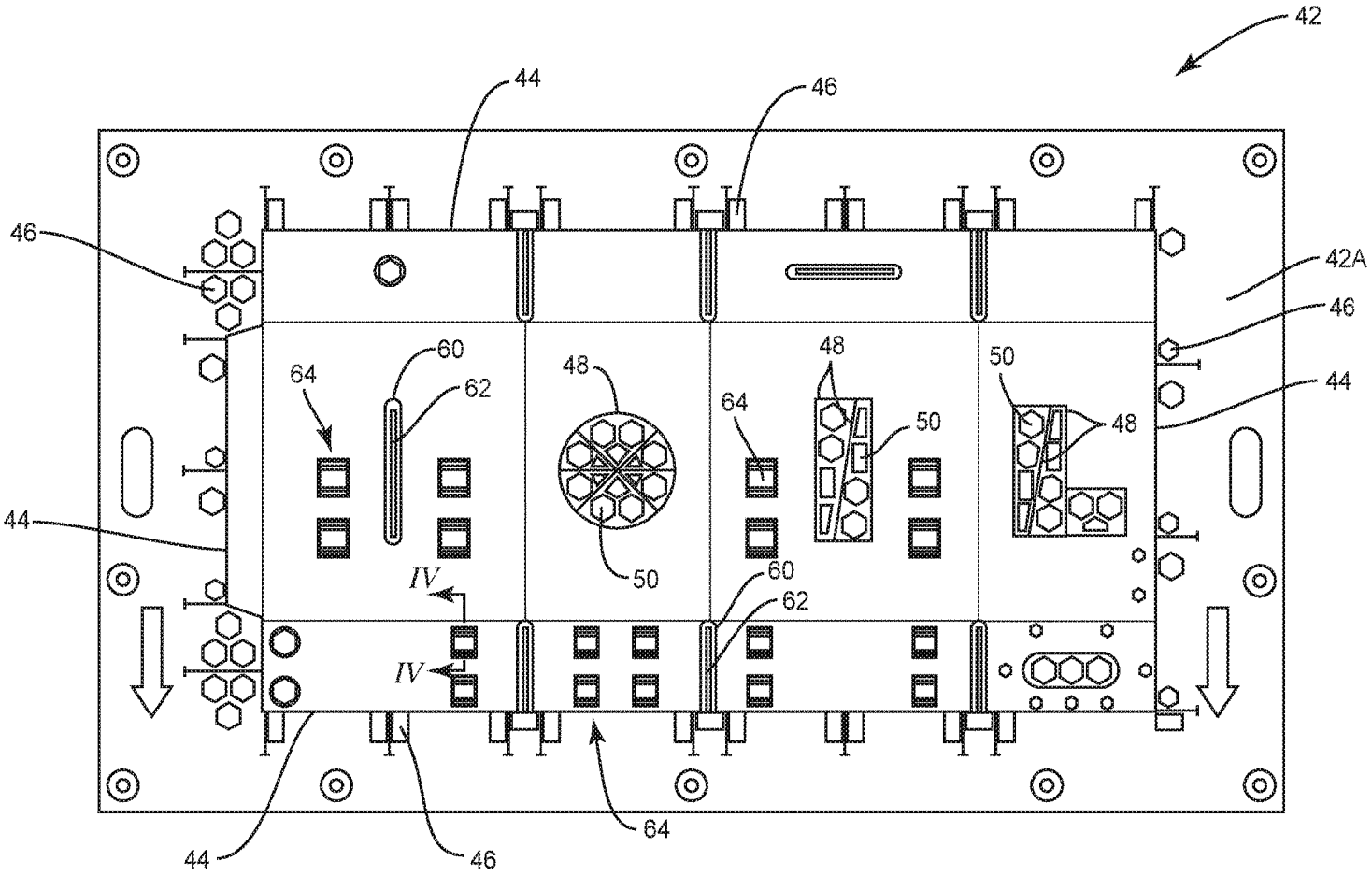
FIG. 2 is a plan view of the rotary cutting die including the die board, as well as one example of the product ejector discussed herein.

With reference to FIGS. 1 and 2, there is shown therein a rotary cutting die apparatus indicated generally by the numeral 30. The rotary cutting die apparatus includes a die board indicated generally by the numeral 42. Die board 42 includes an outer surface 42A and an inner surface 42B. Die board 42 is adapted to be mounted to a die board cylinder 40 that is rotatively mounted adjacent an anvil cylinder 51. For completeness subsequently herein components of the die board 42 will be discussed. Initially, however, the discussion is directed at the design of the product ejectors, indicated generally by the numeral 64, which are mounted in the die board and function to separate the corrugated die cut product from the die board 42. Product ejectors 64 are strategically placed on the die board 42 to efficiently separate the cut product from the die board. In FIG. 2, there is shown numerous product ejectors 64 disposed transversely across a leading portion of the die board 42. There is also product ejectors 64 disposed transversely across intermediate portions of the die board 42 and there may be some product ejectors 64 disposed adjacent the trailing end portion of the die board 42.

Product ejectors 64 are constructed of resilient and compressible material and are designed to be compressed as the die cut product passes through the nip defined between the die board 42 and the anvil cylinder 51. As the die cut product exits the nip, the product ejectors 64 expand or extend to engage the die cut product and efficiently strip the die cut product from various blades on the die board.

Figure 3:
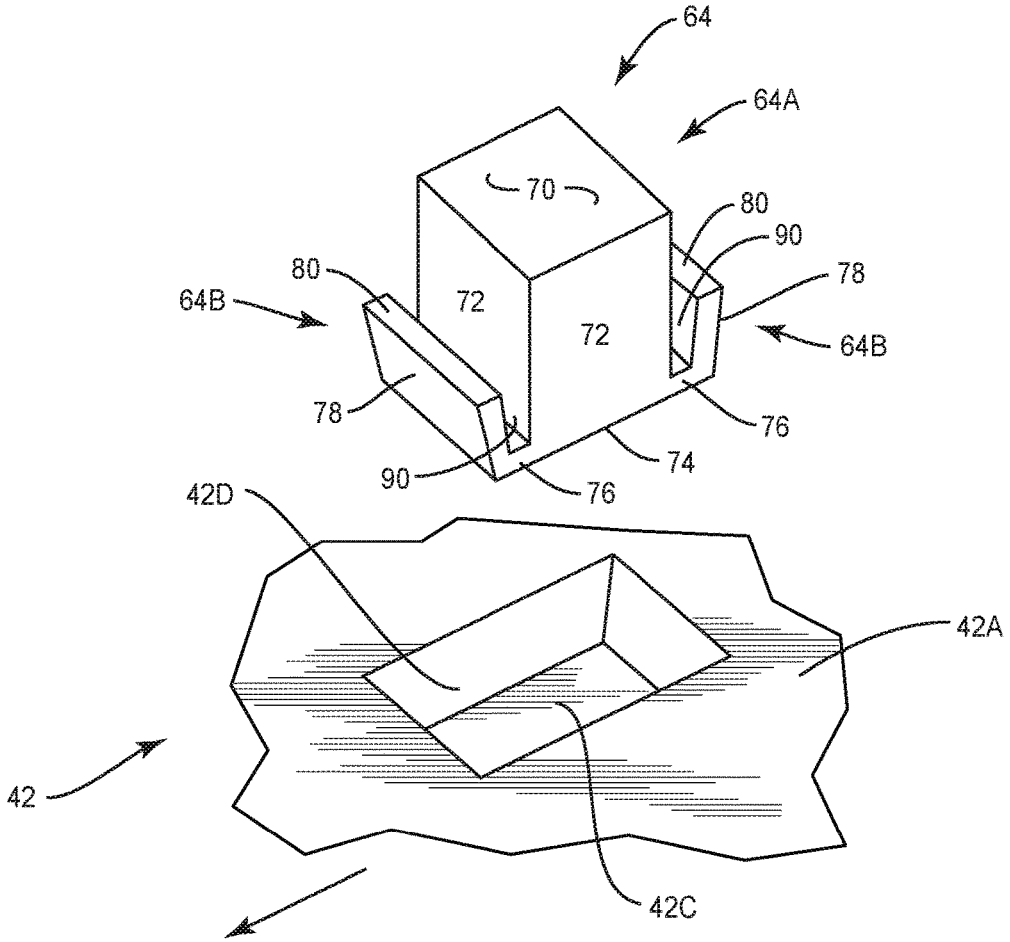
FIG. 3 is an exploded view showing the die board and one embodiment of the product ejector.
Figure 4:
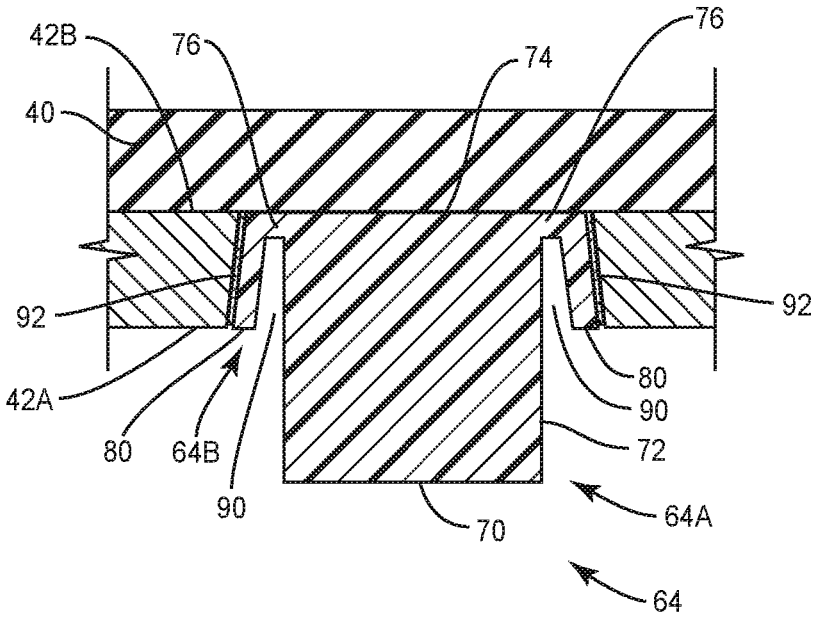
FIG. 4 is a fragmentary sectional view showing the product ejector of FIG. 3 secured to a die board.

In the embodiments illustrated herein, the product ejector 64 is secured directly to the die board 42. With reference to the drawings, particularly FIGS. 3 and 4, it is seen that the die board 42 is provided with one or more openings 42C. See FIG. 3 particularly. Each opening, as will be discussed herein, functions to accept and hold a product ejector 64. In the design shown and discussed herein, the opening 42C is a bore or opening that is formed completely through the die board 42. That is, the opening 42C extends from the outer surface 42A to the inner surface 42B. A wall 42D, as shown in FIG. 3, forms the boundary of opening 42C.

FIG. 3 shows one embodiment of the product ejector 64. Again, the product ejector 64 is comprised of compressible and resilient material and as such is an elastomer. Product ejector 64 shown in FIG. 3 is designed to be inserted into opening 42C and be secured therein by an adhesive or another securing structure or device.

Product ejector 64 shown in FIG. 3 includes a main body indicated generally by the numeral 64A and one or more glue or securement tabs that project from the main body and which are indicated generally by 64B. In the case of the FIG. 3 embodiment, there is provided a pair of glue tabs 64B, one disposed on the leading side of the main body 64A and one on the trailing side of the main body. In the FIG. 3 embodiment, the main body 64A assumes a generally cubical form and includes a plurality of sides with each side being a generally square or rectangular shape. Main body 64A includes an outer surface 70, a series of sides 72 and an inner surface 74. As will be appreciated from reviewing the drawings and the following disclosure, once the product ejector 64 is secured within the opening 42C, the inner surface 74 will generally align with the inner surface 42B of the die board 42. Outer surface 70 will project outwardly past the outer surface 42A when the product ejector 64 is in a no-load condition. See FIG. 4.

As noted above, the product ejector 64 shown in a number of embodiments includes two glue tabs 64B. Each glue tab 64B projects from the leading or trailing side of the main body 64A. In addition, as seen in the drawings, the glue tabs 64B are integral with the main body 64A. Each glue tab 64B includes a base 76 that projects from the inner portion of the main body 64A. In a no-load condition, each glue tab 64B includes a tab that extends at an angle from the base 76. In the case of the embodiments shown in FIGS. 3 and 4, the tab 64A includes an attaching surface 78 and an outer edge 80. See FIG. 3. Formed between the glue tab 64B and the main body 64A is a channel or space 90.

To secure the product ejector 64 in opening 42C of the die board 42, the product ejector is inserted into the opening. Each of the glue tabs 64B are glued by an adhesive layer 92 to the wall 42D of the opening 42C of the die board. The product ejector 64 is glued in a position where the full depth of the opening 42C is utilized. Thus, the inner surface 74 of the main body generally aligns with the inner surface 42B of the die board. In particular, as seen in FIGS. 3 and 4, the attaching surfaces 78 of the glue tabs are glued directly to the wall 42D of the opening 42C. Thus, there is an adhesive layer or an adhesive interface 92 disposed between the wall 42D and each of the glue tabs 64B. See FIG. 4, for example. When properly secured in the die board, the outer surface 70 of the main body 64A extends outwardly past the outer surface 42A of the die board.

As seen in FIG. 4, the main body 64A of the product ejector is substantially isolated from the adhesive layer 92 as well as the glue tabs 64B. The repetitive compression and expansion of the main body 64A does not significantly impact the glue tabs 64B or the adhesive layer 92 that connects the product ejector to the wall 42D. Channel 90 forms spaces between the glue tabs 64B and the main body 64A. These spaces permit portions of the main body 64A to expand into the spaces as the product ejector is compressed while passing through the nip of the rotary die cutting apparatus. This also tends to isolate the main body 64A from glue tabs 64B. Because the main body 64A is generally isolated from the glue tabs 64B and the adhesive layer, shearing and tearing of the product ejector is eliminated or at least substantially reduced.

Tabs 64B are referred to herein as glue tabs or securement tabs. This is because they function to secure the product ejector 64 to the die board 42. In the embodiment shown in FIGS. 3 and 4, tabs 64B are secured to the wall 42D of a respective opening 42C. However, the tabs 64B can be designed to be secured to other parts of the die board and means other than an adhesive can be used to secure the tabs to the die board 42.

Figure 5:
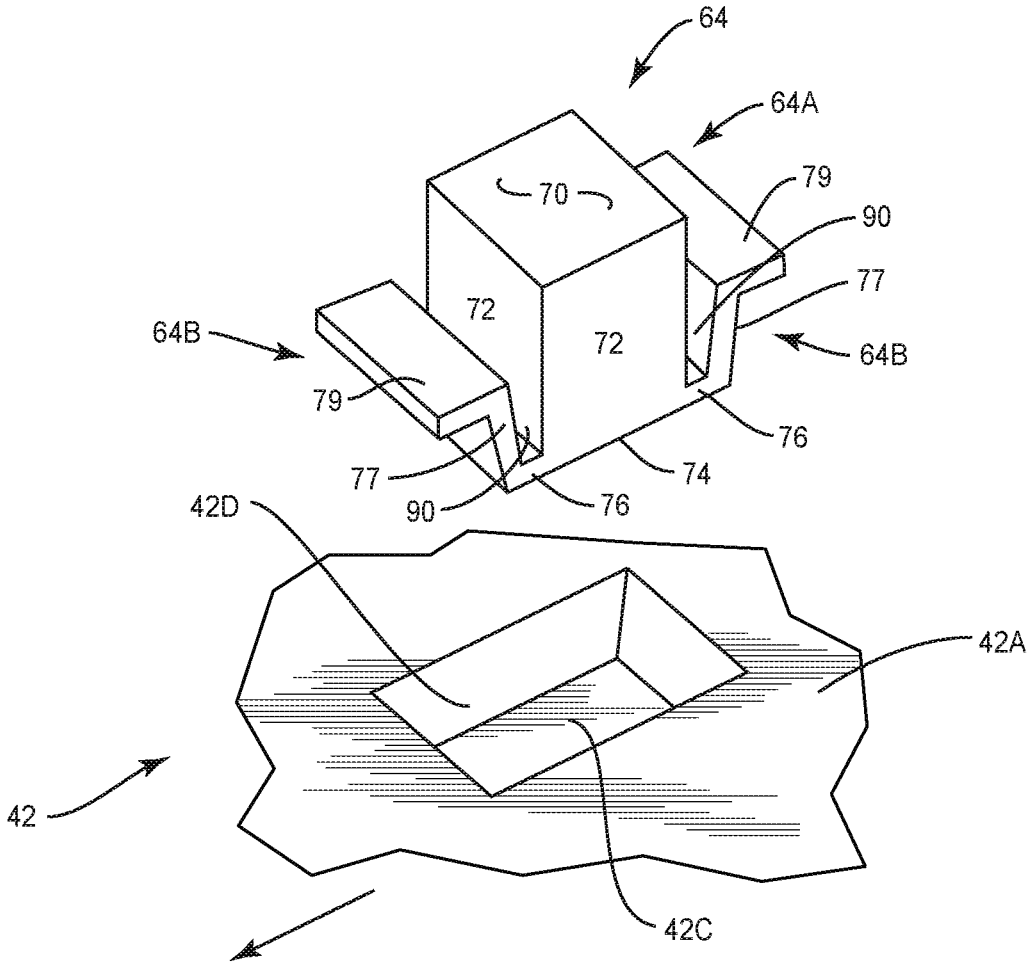
FIG. 5 is an exploded view showing the die board and a second embodiment of the product ejector.
Figure 6:
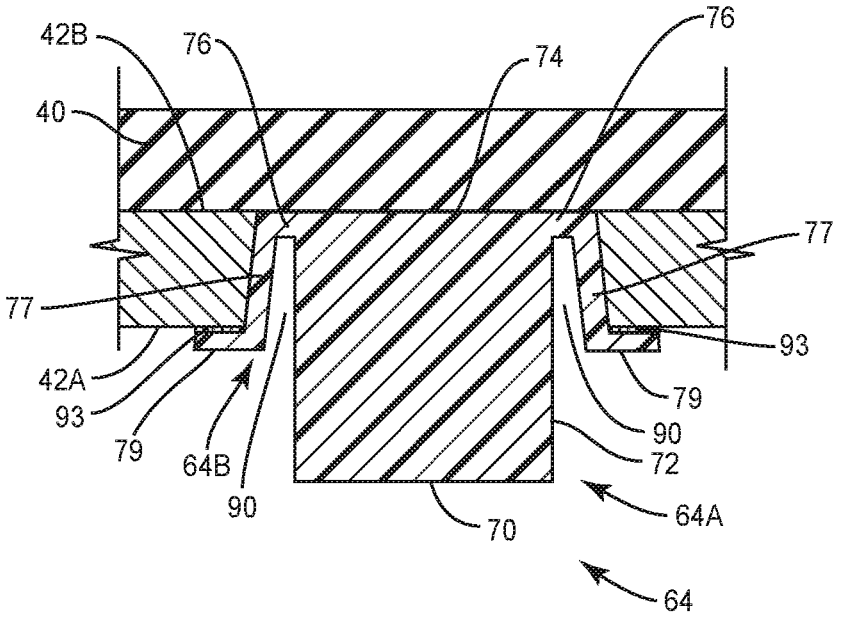
FIG. 6 is a fragmentary sectional view showing the product ejector of FIG. 5 secured to the die board.

FIGS. 5 and 6 show an alternative embodiment of the product ejector 64. The design shown in FIGS. 5 and 6 is similar in many respects to the product ejector shown in FIGS. 3 and 4 and discussed above. However, in the case of the embodiment shown in FIGS. 5 and 6, the tabs 64B are designed to attach to the outer surface 42A of the die board 42. Now with particular reference to FIGS. 5 and 6, note that each securement tabs 64B assumes a generally inverted L-shape. This inverted L-shape forms a flange 79 and an extension 77 that extends generally between the base 76 and the flange 79. The product ejector is designed such that each flange overlaps and extends over a portion of the outer surface 42A of the die board 42. See FIG. 6. As shown in FIG. 6, an adhesive layer 93 is employed between the flange 79 and the outer surface 42A of the die board 42. This enables the product ejector 64 to be entirely secured, in this embodiment, by securing the flange 79 to the outer surface 42A of the die board 42. It is appreciated by those skilled in the art that the outer surface of the extension 77 could also be secured by gluing to the wall 42D of the opening 42C. However, securing the flange 79 to the outer surface 42A of the die board 42 should be sufficient to secure the product ejector 64 to the die board. In another alternate embodiment, the flange 79 can be stapled to the die board. Also, a combination of staples and an adhesive can be employed to secure the flange 79 to the outer surface 42A of the die board.

Figure 7:
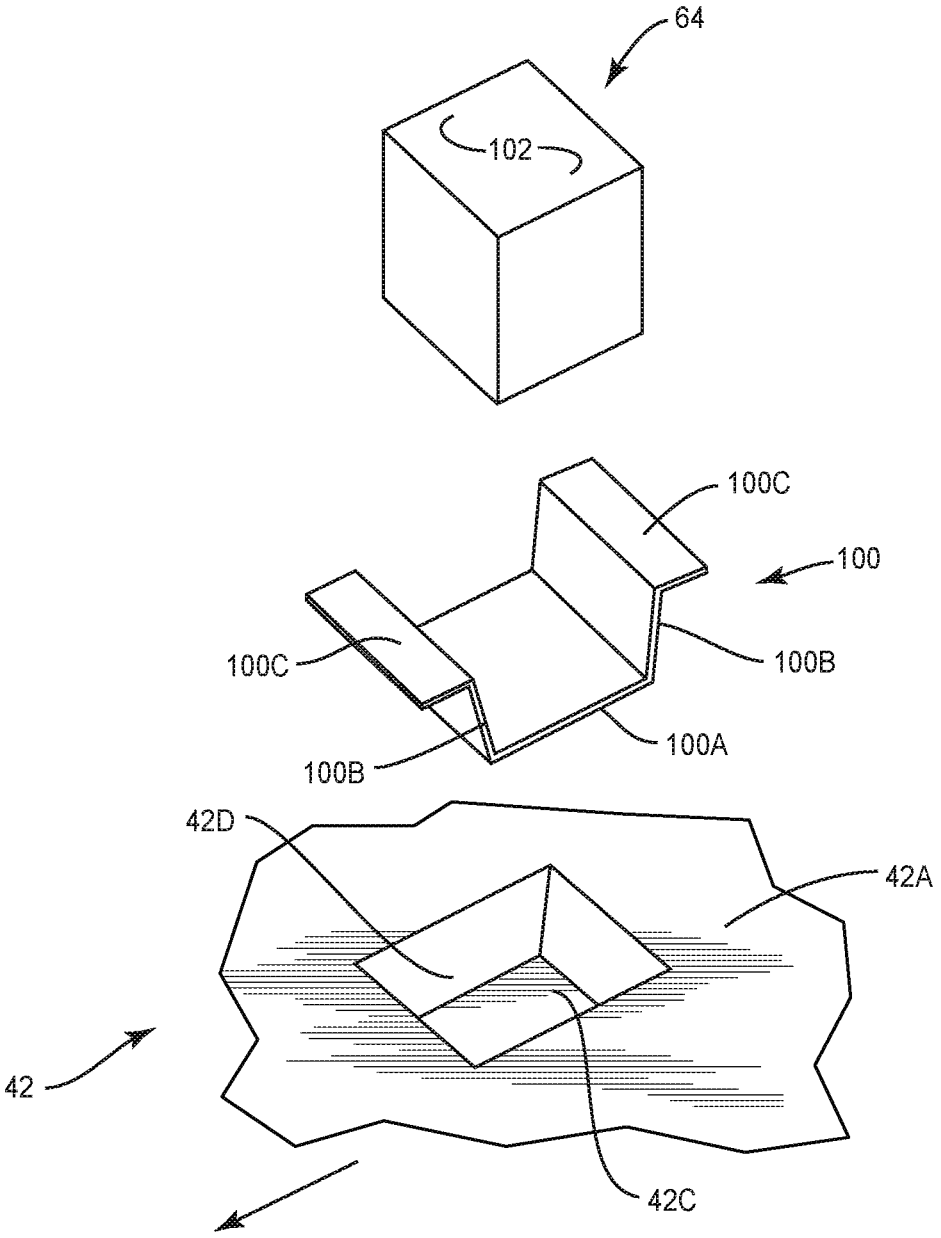
FIG. 7 is an exploded view showing the die board and a third embodiment of the product ejector.
Figure 8:
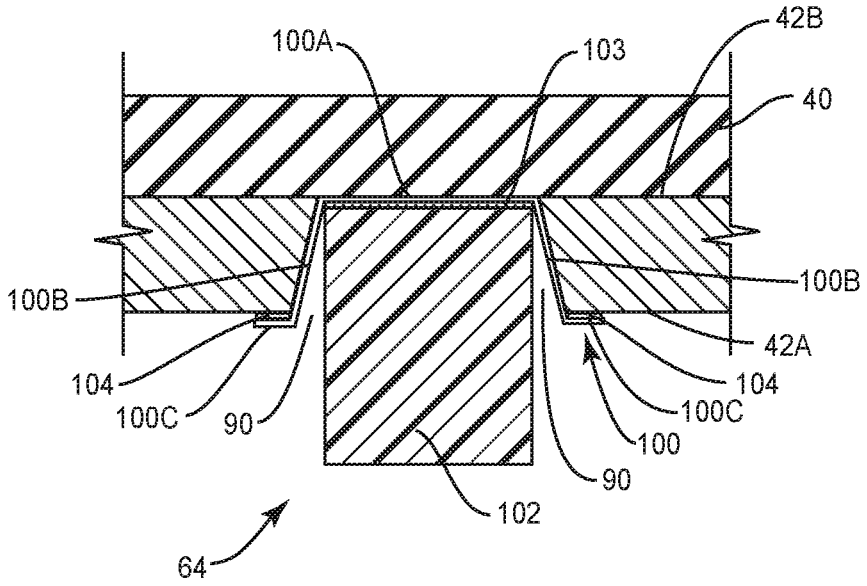
FIG. 8 is a fragmentary sectional view showing the product ejector of FIG. 7 secured to the die board.

Turning to FIGS. 7 and 8, another embodiment of the product ejector 64 is shown. In this case, the product ejector 64 includes a tray 100 that is secured within the opening 42C of the die board 42. Secured to the tray is an elastomer 102 that comprises compressible material and which functions similar to the main body 64A discussed above with respect to the embodiment shown in FIGS. 3, 4, 5 and 6. The tray can be constructed of any suitable material such as plastic, metal, etc. Tray 100 includes a bottom 100A, sides 100B and a flange 100C. It is appreciated that the sides 100B and flange 100C are functionally similar to the securement tabs 64B shown in FIGS. 5 and 6. In any event, the tray 100 is seated into the opening 42C formed in the die board 42. As shown in FIG. 7, it is seen that the bottom 100A of the tray 100 is disposed at or near the bottom of the opening 42C. The elastomer 102 is secured to the bottom 100A by an adhesive layer 103. Flanges 100C are secured to the outer surface 42A of the die board 42 by another adhesive layer 104. Thus, the tray, in this embodiment, is secured within the opening 42C by the adhesive layer 104 that is disposed between the flanges 100C and the outer surface 42A and the die board 42. As with other embodiments, this manner of securement should be sufficient to secure the tray 100 and elastomer 102 within the die board 42. But other means such as staples can be used and can be used in combination with adhesive layers and other portions of the tray 100 can also be secured to the die board 42.

There are numerous advantages associated with the product ejector 64 discussed. First, the product ejectors 64 can extend throughout the full depth of the openings 42C in the die board. This tends to enable more control over the product ejector in terms of the pressure applied to the die cut product. Secondly, by employing the glue tabs 64B to secure the product ejectors to the die board, it follows that the main body 64A or working portion of the product ejector tends to be isolated from the adhesive layer and this will reduce the shearing and tearing of the product ejector as a whole. More particularly, by employing the integral glue tabs and generally isolating the main body from the glue tabs and the adhesive layer, one finds that the glue tabs and adhesive layer are not compressed or, if compressed, the compression is minimal. All of this will lead to a product ejector that will not tend to shear and tear over a period of time and, in the end, will provide longer life.

In describing the product ejector 64, certain terms of reference have been used. For example, "inner" and "outer" are used to describe parts of the product ejector and die board. In construing these terms, they should be construed simply as terms of reference.

Now that the product ejector 64 has been discussed, it may be beneficial to briefly review the basic structure and function of the rotary cutting die apparatus shown in FIGS. 1 and 2. This will give a more complete and unified understanding of how corrugated board is cut and/or scored and some context with respect to the function of the product ejectors 64. With particular reference to FIG. 1, the rotary cutting die apparatus 30 includes a die board cylinder 40 and an anvil cylinder 51. Die board cylinder 40 is designed to receive and hold the curved die board 42. Die board cylinder 40 and the die board 42 are disposed with respect to the anvil cylinder 51 such that the nip is defined between the die board and the anvil. As sheets of corrugated board CB are fed through the nip, the corrugated board is engaged by the die board 42 which trims, cuts and scores the corrugated board. Anvil cylinder 51 is typically surrounded by a sheath 52 which is a relatively durable material such as urethane, which provides a backing surface. As such, the anvil cylinder 51 rotates in a manner that is generally synchronous with the adjacent die board cylinder 40 during normal operations.

Die board 42 is typically constructed of laminated plywood. Die boards, such as that illustrated in FIGS. 1 and 2, typically include a combination of cutting blades, scoring rules, resilient scrap strippers and product ejectors. With reference to FIG. 2, a typical die board 42 is shown therein. Die board 42, as noted above, is curved to fit the die cylinder 40. Die board 42 includes an outer surface 42A that is exposed, as viewed in FIG. 1, and an inner surface 42B which lies adjacent and in contact with the die cylinder 40.

In the exemplary die board 42 shown in FIG. 2, the die board has mounted thereto a series of trim cutting blades 44. As seen in FIG. 2, the trim cutting blades 44 extend around the die board 42. Trim blades 44 function to cut the overall dimensions of a die cut product which can be manipulated to form a box. Thus, as seen in FIG. 1, a sheet of corrugated board CB is fed into the nip and as the corrugated board moves through the nip, the trim blades 44 will cut and form the die cut product.

Associated with the trim blades 44 is a series of trim strippers 46. Trim strippers 46 are secured to the die board adjacent trim blades 44 and function to strip trim from the trim blades as the die cut product emerges from the nip.

Also, a typical die board, such as that shown in FIG. 2, includes scrap cutting blades and strippers to strip scrap from the scrap cutting blades. For example, scrap cutting blades can be used to cut holes, slots and openings in the die cut product. Therefore, it is appreciated that the scrap cutting blades and scrap strippers are typically disposed within the confines of the trim blades 44. In the exemplary die board 42 shown in FIG. 2, there is a series of scrap cutting blades indicated by the numeral 48. Note, for example, the circular trim blade 48 disposed in the second intermediate section of the die board 42 from the left side. Disposed closely adjacent the scrap blades 48 is a series of scrap strippers 50. In the case of the circular scrap blade discussed above, it is seen that there is an array of resilient and compressible scrap strippers 50 disposed within the confines of the circular scrap blade 48. To the right of the circular scrap blade 48 there are other scrap blades that are laid out to cut rectangles or L-shaped scrap pieces from the corrugated board. The scrap blades also have scrap strippers 50 associated therewith. Note also in FIG. 2 where scrap blades are utilized to cut slots in the corrugated board. In the example illustrated, there is a series of scrap blades 60 that conform to an elongated slot for cutting a slot in the corrugated board. Disposed interiorly of the scrap blades 60 are scrap strippers 62 for ejecting scrap from the die cut product as it exits the nip. It is appreciated that the scrap strippers are positioned on the die board 42 to align with the piece of scrap being cut by the adjacent scrap blades. Again, as the corrugated board passes through the nip of the rotary die cutting apparatus 30, the scrap strippers will be compressed between the cut scrap pieces and the corrugated board and when the cut die product exits the nip, the scrap strippers will expand and in the process will extend to engage the cut pieces of scrap and strip the scrap from the adjacent scrap cutting blade or blades.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting corrugated board fed into a nip disposed between the cylinder and a rotating anvil to produce a die cut product, the rotary cutting die comprising:

a curved die board configured to be mounted to the die cylinder and including inner and outer surfaces;

one or more cutting blades mounted on the die board for cutting the corrugated board fed through the nip to produce the die cut product;

one or more openings formed in the die board with each opening having a wall;

a product ejector secured in the one or more of the openings for engaging a portion of the die cut product passing through the nip and assisting in separating the die cut product from the cutting die;

each product ejector comprising compressible material and including a main body and in a no-load condition the main body projecting outwardly from the opening past the outer surface of the die board;

the product ejector further including one or more securement tabs integral with the main body for securing the main body to the die board;

each securement tab being generally isolated from the main body by a space formed between the securement tab and the main body;

wherein the securement tab projects along the wall of the opening and includes a flange that turns and overlaps onto the outer surface of the die board; and an adhesive layer disposed between the flange of the securement tab and the outer surface of the die board for securing the product ejector to the die board.

2. The rotary cutting die of claim 1 when each product ejector includes an inner portion disposed in an inner portion of a respective opening in the die board; and wherein the inner portion of the product ejector forms a portion of the main body and forms a part of the securement tab.

3. The rotary cutting die of claim 2 wherein the securement tab projects along the wall of the opening in the die board.

4. The rotary cutting die of claim 1 wherein the product ejector includes two securement tabs disposed on opposite sides of the main body and wherein there is formed a channel between each securement tab and the main body.

5. A rotary cutting die adapted to be mounted on a rotary die cylinder for cutting corrugated board fed into a nip disposed between the cylinder and a rotating anvil to produce a die cut product, the rotary cutting die comprising:

a curved die board configured to be mounted to the die cylinder and including inner and outer surfaces;

one or more cutting blades mounted on the die board for cutting the corrugated board fed through the nip to produce the die cut product;

one or more openings formed in the die board with each opening having a wall;

a product ejector secured to the die board and disposed in one of the openings, the product ejector comprising:

(a) a tray having a bottom and side wall disposed in the opening;

(b) the bottom of the tray disposed in an inner portion of the opening;

(c) the side wall projecting outwardly from the bottom of the tray;

(d) the side wall having a flange that overlaps the outer surface of the die board and wherein the flange is secured to the outer surface of the die board; and (e) an ejector comprising compressible material secured to the bottom of the try and projecting through the opening and extending past the outer surface of the die board for engaging a portion of the die cut product passing through the nip and assisting in separating the die cut product from the cutting die.

6. The rotary cutting die of claim 5 wherein the flange of the side wall is secured to the outer surface of the die board by an adhesive or by one or more staples.

7. The rotary cutting die of claim 5 wherein the tray is constructed of plastic material.

* * * * *